US010883225B2

(12) United States Patent
Gaspari et al.

(10) Patent No.: US 10,883,225 B2
(45) **Date of Patent: *Jan. 5, 2021**

(54) DOCTOR BLADE HOLDER FOR CYLINDERS, AND SYSTEM COMPRISING A CYLINDER AND A DOCTOR BLADE HOLDER

(71) Applicant: ORADOC S.R.L., San Pietro a Vico (IT)

(72) Inventors: Roberto Gaspari, Capannori (IT); Andrea Orlandini, San Concordio (IT)

(73) Assignee: ORADOC S.R.L., San Pietro a Vico (IT)

( * ) Notice: Subject to any disclaimer, the term of this patent is extended or adjusted under 35 U.S.C. 154(b) by 137 days.

This patent is subject to a terminal disclaimer.

(21) Appl. No.: 15/969,136

(22) Filed: May 2, 2018

(65) Prior Publication Data

US 2018/0320315 A1 Nov. 8, 2018

(30) Foreign Application Priority Data

May 3, 2017 (IT) ..... 102017000047269

(51) Int. Cl.

| | |
|---|---|
| ***D21G 3/04*** | (2006.01) |
| ***D21G 3/00*** | (2006.01) |
| ***B31F 1/14*** | (2006.01) |

(52) U.S. Cl.

CPC ..... *D21G 3/04* (2013.01); *B31F 1/145* (2013.01); *D21G 3/005* (2013.01)

(58) Field of Classification Search

CPC .. D21G 3/005; D21G 3/04; B31F 1/14; B31F 1/145; B05C 11/042

See application file for complete search history.

(56) References Cited

U.S. PATENT DOCUMENTS

| | | | | |
|---|---|---|---|---|
| 1,594,284 A * | 7/1926 | Vickery | ..... | D21G 3/005 15/256.51 |
| 1,812,920 A * | 7/1931 | Ballard | ..... | B41F 9/1036 101/157 |
| 2,477,339 A * | 7/1949 | Ljungquist | ..... | D21G 3/005 15/256.51 |
| 3,040,442 A * | 6/1962 | Overton | ..... | F26B 17/286 34/110 |
| 3,859,690 A | 1/1975 | Brown | | |

(Continued)

FOREIGN PATENT DOCUMENTS

| | | | |
|---|---|---|---|
| CA | 3002069 A1 * 11/2018 | ..... | D21G 3/04 |
| CA | 3002080 A1 * 11/2018 | ..... | B31F 1/145 |

(Continued)

*Primary Examiner* — Jose A Fortuna

(74) *Attorney, Agent, or Firm* — McGlew and Tuttle, P.C.

(57) ABSTRACT

The doctor blade holder (7) comprises:

a plurality of fingers (35) mounted on a beam (9), hinged around a rotation axis (37A) and configured to cumulatively form a housing seat (41) for the doctor blade (43); wherein the fingers (35) are pivotable independently from one another around said rotation axis (37A);

at least one actuator (51) comprising at least one chamber (53) that can be inflated with pressurized fluid, configured and arranged so as to generate a thrust (f53) on the fingers (35) to make them pivot around said rotation axis (37A).

Each finger (35) can be mounted and removed independently from the others on said beam (9).

23 Claims, 13 Drawing Sheets

(56) References Cited

U.S. PATENT DOCUMENTS

| | | | | |
|---|---|---|---|---|
| 3,955,531 | A | 5/1976 | Brown | |
| 4,114,228 | A * | 9/1978 | Brown | D21G 3/005 101/425 |
| 4,192,709 | A * | 3/1980 | Dunlap | B31F 1/14 15/256.51 |
| 4,665,859 | A * | 5/1987 | Dunlap | D21G 3/005 118/126 |
| 4,789,432 | A * | 12/1988 | Goodnow | B05C 11/042 101/169 |
| 8,202,395 | B2 * | 6/2012 | Eriksson | D21G 3/04 162/111 |
| 10,633,795 | B2 * | 4/2020 | Gaspari | D21G 3/005 |
| 2010/0032112 | A1 * | 2/2010 | Eriksson | D21G 3/04 162/111 |
| 2018/0320314 | A1 * | 11/2018 | Gaspari | B31F 1/145 |
| 2018/0320315 | A1 * | 11/2018 | Gaspari | B31F 1/145 |

FOREIGN PATENT DOCUMENTS

| | | | | |
|---|---|---|---|---|
| EP | 3399098 | A1 * | 11/2018 | D21G 3/04 |
| EP | 3399099 | A1 * | 11/2018 | D21G 3/04 |

* cited by examiner 1
1S
A-A
3
5
25A
7
9
23
29
33
19
11A
31

DOCTOR BLADE HOLDER FOR CYLINDERS, AND SYSTEM COMPRISING A CYLINDER AND A DOCTOR BLADE HOLDER

TECHNICAL FIELD

The present invention relates to a doctor blade holder, for example for a creping doctor blade co-acting with a Yankee cylinder or for any doctor blade co-acting with the cylindrical surface of a cylinder or roller rotating around its axis.

BACKGROUND ART

In paper making machines, in particular tissue paper, a Yankee cylinder is normally used to dry the paper before winding it in a reel. One or more doctor blades co-act with the Yankee cylinder, with one of their edges pressed against the cylindrical surface of the Yankee cylinder. The purpose of these doctor blades is to detach the ply of cellulosic fibers from the Yankee cylinder and to carry out any other operations, for example cleaning. The Yankee cylinder can be provided with a single doctor blade or several doctor blades placed in sequence.

Doctor blades are also used in combination with other types of cylinders or rollers, for example drying rollers.

The doctor blade of a creping device is usually inserted inside a doctor blade holder that forms a housing seat for the doctor blade. The doctor blade is pressed against the cylindrical surface of the rotating cylinder with a system that can be rigid or flexible. In flexible systems the fingers that support the doctor blade and that define the housing seat for the doctor blade are thrust by a pressurized fluid chamber against the cylindrical surface of the rotating cylinder. The flexibility of the pressurized fluid chamber makes the doctor blade flexible. Flexible systems are described, for example, in the U.S. Pat. Nos. 3,859,690 and 3,955,531. These systems have some advantages, in particular as regards the possibility of adapting the profile of the doctor blade to the shape of the cylindrical surface. However, they have some limits. In particular, they are prone to breakages and can be difficult to maintain and use.

The fingers are generally fixed integral to one another by means of a "plate" that extends in transverse direction to the axis of the machine. This "plate" is generally relatively thin, so that it is sufficiently elastic to allow each finger to take a different angular position with respect to the position of adjacent fingers. The assembly of the fingers connected to one another (defining a pressure plate) is mounted on the load-bearing structure, typically a beam, by means of a hole made in each finger, into which a rod of a length corresponding to the doctor blade holder is inserted. When a finger breaks or is damaged and must be replaced, the rod is removed and the pressure plate is then detached. The damaged fingers must be separated from the pressure plate, replaced and reconnected with the plate. To avoid the lengthy machine downtime necessary for these mounting and removal operations, spare pressure plates are normally provided, so that when a finger of the operating doctor blade holder breaks, the whole assembly of fingers is replaced with a single operation and the damaged pressure plate is repaired separately.

In other systems, known as rigid, the housing seat for the doctor blade is fixed rigidly to a support or beam, which is thrust toward the cylinder by suitable actuators. These systems are of much simpler construction than flexible systems, but also have some drawbacks, in particular due to the difficulty of adapting the shape of the doctor blade to the cylindrical surface of the cylinder. This latter can in fact have a shape that differs from the perfectly cylindrical geometrical shape and can have a camber, with a larger diameter in the intermediate portion and a smaller diameter at the ends of the cylinder. This makes it necessary for the doctor blade to be thrust against the cylindrical surface with very high pressures, resulting in increased frictions and torques, as well as wear.

Normally the support, or beam, of the doctor blade holder is mounted on the stationary load-bearing structure so as to rotate around an axis substantially parallel to the rotation axis of the cylinder with which the doctor blade mounted in the doctor blade holder co-acts. The doctor blade approaches the cylindrical surface of the cylinder or roller by means of a pivoting movement of the beam around the respective rotation axis. For this purpose, the beam is supported by means of bearings that define restraint, substantially representing hinges. The beam thus mounted is prone to deformations and vibrations in a non-negligible manner under the thrust generated by the contact pressure between the doctor blade and the cylinder. This deformation can cause difficulties in the operation of the cylinder and of the doctor blade co-acting therewith.

There is therefore a need to produce doctor blade holders that completely or partly overcome the drawbacks and the limits of doctor blade holders of the current art.

SUMMARY OF THE INVENTION

According to a first aspect, a doctor blade holder for a doctor blade is provided, adapted to co-act with a cylindrical surface of a rotating cylinder, for example a Yankee cylinder or a drying cylinder, comprising a plurality of fingers mounted on a beam, which are hinged around a rotation axis and configured to cumulatively form a housing seat for a doctor blade. The fingers are pivotable independently from one another around the rotation axis. Moreover, the doctor blade holder can be provided with at least one thrust member, such as for instance an actuator. The thrust member can comprise at least one chamber that can be inflated with pressurized fluid, adapted to generate a thrust on the fingers to make them pivot around the rotation axis toward the cylindrical surface of the rotating cylinder, with which the doctor blade co-acts. In other embodiments, the thrust member can comprise a spring or a plurality of springs. Advantageously, each finger can be mounted and removed independently from the others with respect to the beam.

In this way it is possible to replace each finger independently from the others, without removing a common hinge member and the whole pressure plate. Maintenance of the doctor blade holder is thus simpler and it is no longer necessary to have several spare assembled doctor blade holders for replacement in the case of breakage of one or more doctor blade holder fingers during operation.

The blade holder can be an elastic blade holder or a rigid blade holder.

According to a different aspect, disclosed herein is a doctor blade holder for a doctor blade adapted to co-act with a cylindrical surface of a rotating cylinder, comprising a plurality of fingers mounted on a beam, hinged around a rotation axis and configured to cumulatively form a housing seat for a doctor blade. The fingers are pivotable independently from one another around the rotation axis. The doctor blade holder further comprises at least an actuator comprising at least one chamber that can be inflated with a pressurized fluid, configured and arranged so as to generate a thrust on the fingers to make them pivot around said rotation axis. Each finger can also comprise a locking element, to rigidly lock the finger to the beam. In this way, a doctor blade holder can be obtained that can alternatively act as a flexible doctor blade holder and as a rigid doctor blade holder of the current art, combining in the same device the advantages of the two currently known types of doctor blade holder.

In fact, with this configuration it is for example possible to carry out "profiling" of the doctor blade, i.e. to shape the doctor blade adapting it to the profile of the cylinder, whose cylindrical surface can deviate from a perfectly cylindrical geometry and have, for example, a camber. Using the actuator comprising the chamber that can be inflated by means of the pressurized fluid, through each finger the same pressure (isostatic pressure inside the inflatable chamber) is applied to various areas of the doctor blade; each finger can take a different angular position with respect to the others. In this way, the various areas of the doctor blade and more precisely of the edge thereof deform following the profile of the cylinder applying substantially the same stress along the whole of the extension of the doctor blade. Once this arrangement has been reached, with the edge of the doctor blade that adapts to the profile of the cylinder, the various fingers can be locked in a substantially rigid manner with respect to the beam transforming the doctor blade holder from a flexible doctor blade holder to a rigid doctor blade holder. This latter, during operation of the cylinder will offer all the typical advantages of the rigid system, without being affected by the defects and by the drawbacks of these systems, mainly consisting of the impossibility of carrying out correct profiling of the doctor blade.

In substance, a doctor blade holder of this type allows the doctor blade to be optimally shaped on the profile of the cylinder exerting constant pressure and causing a deformation that can vary locally from area to area, due to the flexibility of the inflatable chamber and to fact that each finger can pivot independently from one another. After reaching the correct shape of the doctor blade, without the need to apply excessive localized pressures as is instead necessary in rigid systems, the fingers can be locked on the beam so that the doctor blade holder as a whole will operate as a normal rigid doctor blade holder.

According to yet another aspect, there is provided a doctor blade holder for a doctor blade adapted to co-act with a cylindrical surface of a rotating cylinder, comprising a beam extending longitudinally between two opposite ends and carrying a housing seat for the doctor blade, substantially in a direction approximately parallel to the rotation axis of the cylinder with which the doctor blade co-acts. The beam can advantageously be coupled to the load-bearing structure by means of a system of linear guides, positioned at the two ends of the beam. The guides can be placed to define a direction of movement of the doctor blade mounted on the doctor blade holder toward and away from the cylinder. In other embodiments the beam can be coupled to the load-bearing structure in a fixed position.

Actuators can also be provided, which are configured and arranged so as to move each end of the beam along the system of linear guides and in this way push the beam toward the cylindrical surface of the cylinder or roller with which the doctor blade mounted in the doctor blade holder co-acts.

While in the doctor blade holder of the current art the beam moves toward the cylinder by rotation, according to t embodiment the beam can move toward the cylinder by translation.

The greater rigidity offered by the linear guides reduces the flexural deformability of the beam and consequently the deflection that forms as a result of the force applied by the cylindrical surface of the roller against the doctor blade mounted on the beam.

A doctor blade holder of the type described above can comprise a counter-blade, on which the fingers act. The counter-blade can be arranged between the fingers and the doctor blade, on the opposite side with respect to the cylindrical surface with which the doctor blade co-acts, to press on the doctor blade housed in its housing seat formed by the fingers of the doctor blade holder.

In some embodiments, a support element can be arranged between the doctor blade and the fingers that form the housing seat for the doctor blade.

When the doctor blade holder comprises a counter-blade housed, or that can be housed, together with the doctor blade, in the housing seat formed by the fingers, the support element can be arranged advantageously between each finger and the counter-blade, while the doctor blade rests directly on the counter-blade.

In a doctor blade holder of the type described above each finger can, for example, comprise a first portion, defining the housing seat for the doctor blade, and a second portion, co-acting with the inflatable chamber. The rotation axis can advantageously be located between the first portion and the second portion.

The first portion and the second portion of each finger can be placed at an angle to one another, preferably at an angle of between 60° and 120°, more preferably between 80° and 100°, for example at 90°. In other embodiments, the first portion and the second portion of each finger can be coplanar, to form an angle of 180° between them.

To facilitate assembly of the fingers on the supporting beam, on a doctor blade holder as described above each finger can comprise a hinge pin, for example arranged in an intermediate position between a first portion of the finger and a second portion of the finger.

In other embodiments, the rotation axis can be arranged at a proximal end of each finger, which extends from the proximal end to a distal end, from which the doctor blade co-acting with the cylindrical surface of the rotating cylinder projects. In this case the hinge pin is positioned at the proximal end of the finger. The actuator that generates the thrust of the doctor blade against the cylindrical surface of the rotating cylinder is in this case positioned between the rotation axis and the distal end of the fingers.

For each finger the beam can comprise an openable support, in which the hinge pin of the respective finger is rotatingly engaged. Each support can in this way be opened and closed independently from the others and each finger can be mounted on and removed from the beam without the need to act on the adjacent fingers, simply by opening the respective support to remove the hinge pin of a damaged finger, for example, and inserting the hinge pin of a new finger to replace the damaged one.

In the embodiments in which each finger is provided with a locking element to make the doctor blade holder rigid, the locking element can comprise, for each finger, a pair of screws co-acting with the beam and with the finger. In particular, a pair of screws, one configured to push the finger against the beam and the other to pull the finger away from the beam, can be provided. By clamping both screws the finger is rigidly locked in the desired position with respect to the beam For example, the locking elements can be arranged so as to co-act with the second portion of the respective finger, i.e., the one adjacent to the portion that contributes to define the housing seat for the doctor blade.

In a doctor blade holder of the type described herein, in one or other of the aforesaid embodiments, each end of the beam can be provided with an adjustable stop, which defines the working position of the doctor blade holder, and therefore of the doctor blade, with respect to the cylinder, with which the doctor blade holder is associated. The stop can be adjusted by means of a servomotor, for example an electronically controlled stepper motor, so as to regulate or adjust the working position precisely. Two stops can be provided, one for each end of the beam. Each stop can be adjusted independently from the other.

In other embodiments, only a system of actuators can be provided, to push the beam toward the cylinder. In further embodiments, only a system of one or more servo-motors to move the beam toward the cylinder or a combination of thrust actuators and manually adjustable stops can be provided.

In some embodiments, each end of the beam can be coupled to a respective slide. Each slide can be movable along a corresponding system of linear guides. The beam can be coupled to the two opposite end slides such as to be movable with respect to said slides. For example, in some embodiments the beam can be provided with a reciprocating translation movement parallel to its longitudinal extension, and therefore in a direction substantially parallel to the edge of the doctor blade and to the rotation axis of the cylinder with which the doctor blade co-acts. The reciprocating movement can be imparted by a suitable actuator, for example an electric motor, a hydraulic motor, a linear actuator such as a piston-cylinder actuator or the like. In substance, in this case, the beam is not directly coupled to the system of preferably straight linear guides, which allow it to move toward or away from the cylinder with which the doctor blade co-acts, but is supported at the ends by the two guides integral with the slides. In this way it is possible to provide the beam, and correspondingly the doctor blade mounted thereon, with a reciprocating movement with a suitable stroke, even a relatively limited one (for example a few centimeters), to prevent concentrated wear of the doctor blade and/or of the cylindrical surface of the cylinder, with which the doctor blade co-acts.

For example, the ends of the beam can be coupled to the respective slides by means of sliding guides substantially parallel to the longitudinal extension of the beam.

Also disclosed herein is a system comprising a cylinder rotating around a rotation axis, for example a Yankee cylinder, a drying cylinder or the like, and a doctor blade holder as described above, co-acting with a cylindrical surface of the rotating cylinder. When in use, the system also comprises a doctor blade and optionally a counter-blade inserted in the seat for the doctor blade holder.

To facilitate mounting and removal thereof, the doctor blade and the pressure counter-blade, when present, can in turn be mounted in a cartridge, which is inserted in the seat and removed from the seat which houses the doctor blade and the counter-blade, with which the doctor blade holder is provided.

According to yet another aspect, there is provided a doctor blade holder for a doctor blade adapted to co-act with a cylindrical surface of a rotating cylinder, comprising a beam extending longitudinally between two opposite ends and carrying a seat for the doctor blade, wherein there are also provided in combination: thrust actuators to bring the doctor blade holder into contact with adjustable stops, which define a working position of the doctor blade with respect to the cylindrical surface of the rotating cylinder, and servo-actuators for adjusting the position of the adjustable stops. In some embodiments, there are provided two stops and two actuators, positioned at the ends of the beam that supports the doctor blade holder.

BRIEF DESCRIPTION OF THE DRAWINGS

The invention will be better understood by following the description and accompanying drawings, which show non-limiting practical embodiments of the invention. In particular, in the drawings.

DETAILED DESCRIPTION OF EMBODIMENTS

Figure 1:
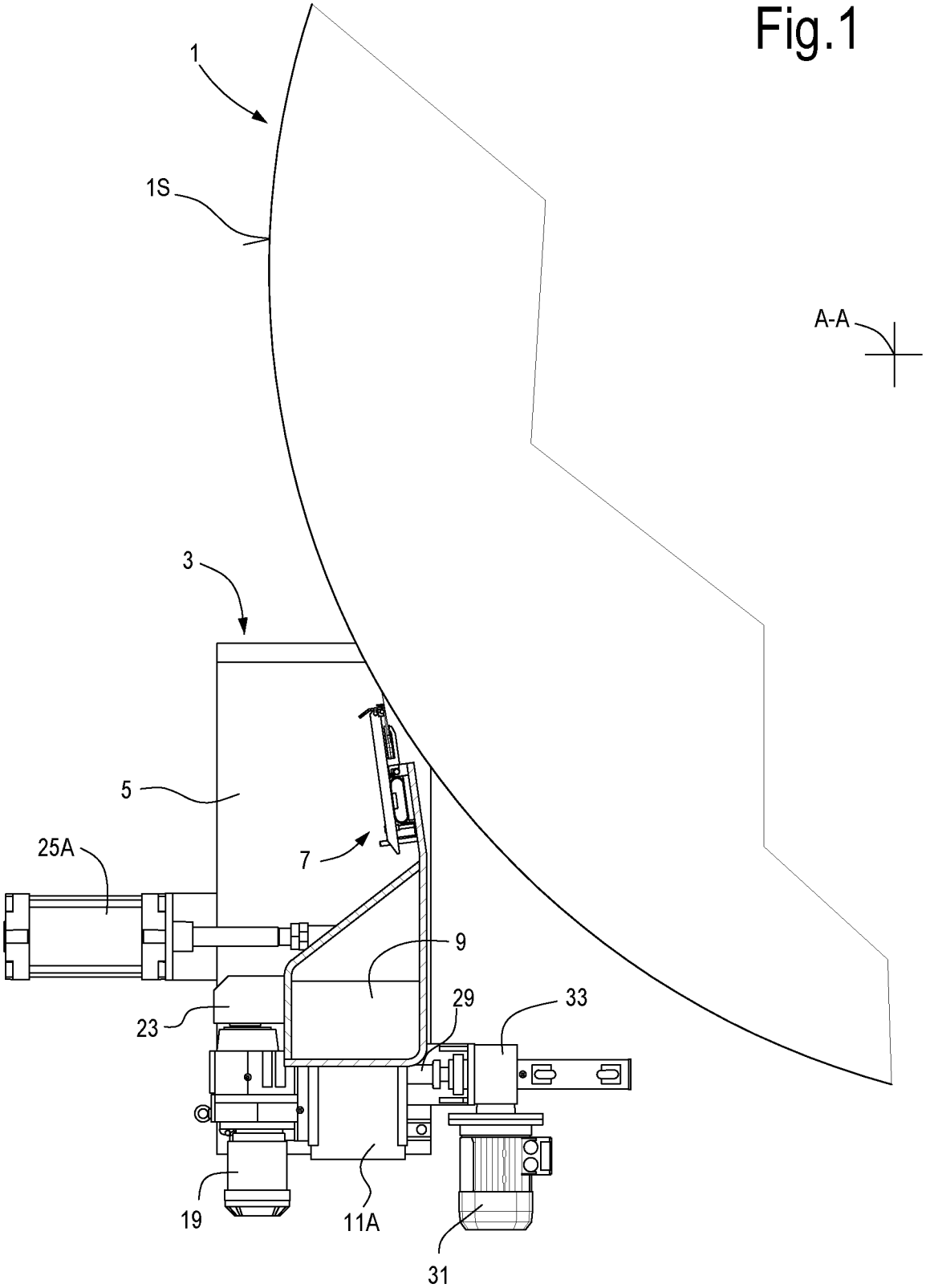
FIG. 1 shows a section of a system comprising a Yankee cylinder and a creping device comprising a doctor blade holder and a creping doctor blade, in a section according to a plane orthogonal to the rotation axis of the Yankee cylinder.

The following detailed description of embodiments given by way of example refers to the accompanying drawings. The same reference numbers in different drawings identify identical or similar elements. Moreover, the drawings are not necessarily to scale. The following detailed description does not limit the invention. Rather, the scope of the invention is defined by the accompanying claims.

Reference in the description to "an embodiment" or "the embodiment" or "some embodiments" means that a particular characteristic, structure or element described in relation to an embodiment is included in at least one embodiment of the object described. Therefore, the phrase "in an embodiment" or "in the embodiment" or "in some embodiments" used in the description does not necessarily refer to the same embodiment or embodiments. Furthermore, the particular characteristics, structures or elements may be combined in any appropriate manner in one or more embodiments.

Hereunder, there will be described in particular a creping device comprising a doctor blade holder and a creping doctor blade, and a system consisting of a Yankee cylinder and a creping device. Nonetheless, it must be understood that the various features and embodiments described herein for the doctor blade holder can also be used in other applications, for example for a doctor blade holder of a scraper blade or a cleaning blade for a Yankee cylinder, and in general for doctor blade holders generically intended to support a doctor blade co-acting with a rotating cylinder or roller.

A first embodiment of a creping device comprising a doctor blade holder and related creping doctor blade in a system including a Yankee cylinder is illustrated in FIGS. 1 to 7. The reference numeral 1 generically indicates a Yankee cylinder, which has a cylindrical lateral surface 1S. In the present context, "cylindrical surface" is intended as the lateral surface of the cylinder or roller 1, the surface of which may deviate with respect to a geometrically cylindrical shape and have, for example, a camber. Therefore, in the present description and in the appended claims the term "cylindrical" must be intended not in the geometric but rather in the engineering sense.

A creping device, indicated as a whole with 3, co-acts with the Yankee cylinder 1. Besides the creping device 3, other doctor blade systems can co-act with the Yankee cylinder 1, for example a cleaning blade and/or a scraper blade, not shown in the drawings, each of which can be carried by a doctor blade holder having at least some of the features described with reference to the doctor blade holder of the creping device 3.

In fact, features described herein with reference to the creping device 3 can also be used in the production of the doctor blade holder for the scraper blade and/or in the production of the doctor blade holder of the cleaning blade.

The reference numeral 5 schematically indicates a portion of a generic stationary support structure, which can be part of the structure that also supports the Yankee cylinder 1.

The creping device 3 comprises a doctor blade holder 7, which extends approximately parallel to the rotation axis A-A, around which the Yankee cylinder 1 rotates. The doctor blade holder 7 is supported by a beam 9, which can be part of the doctor blade holder itself. The beam 9 can extend longitudinally approximately parallel to the rotation axis A-A of the Yankee cylinder 1. The beam 9 comprises two ends 9A, 9B that can be connected to the stationary support structure 5. In some embodiments, the beam can be connected to the stationary support structure 5 by means of a system of bearings that allow the beam to pivot around an axis substantially parallel to the longitudinal extension of the beam. Another and more advantageous type of connection between the stationary support structure 5 and the beam 9 will be described in detail hereunder.

In some embodiments the beam 9 is not coupled directly to the load-bearing structure 5, but rather at the ends 9A, 9B of the beam 9 there are associated slides 11A and 11B, which support the ends 9A, 9B of the beam 9 in a manner described below. The slides 11A, 11B can in turn be coupled in a movable manner, illustrated below, to the stationary support structure 5.

In the embodiment illustrated, each slide 11A, 11B is slidingly engaged with a system of preferably linear, for example straight, guides 13. In the embodiment illustrated, at each end 9A, 9B of the beam 9, and therefore at each slide 11A, 11B, there is associated a pair of preferably straight linear guides 13, fixed to the stationary support structure 5 and parallel to one another. Each slide 11A, 11B is slidingly engaged with the respective linear guides 13 by means of shoes 14.

In some embodiments, each slide 11A, 11B can be provided with further linear guides 15. These are visible in particular in FIG. 4 for the slide 11B. In advantageous embodiments, each slide 11A, 11B comprises two linear guides 15 parallel to each other. Shoes 17, rigidly coupled to the respective ends 9A, 9B of the beam 9, engage with the linear guides 15.

With this arrangement the beam 9 can move in a direction fA, substantially parallel to the rotation axis A-A of the Yankee cylinder 1, and in a direction fB at right angles to the direction fA and placed according to the extension of the linear guides 13. The position of the linear guides 13 is such that the movement according to the double arrow fB of the slides 11A, 11B allows the beam 9 to move toward and away from the cylindrical surface 1S of the Yankee cylinder 1 for the purposes that will be clarified below.

The movement according to the double arrow fA is a reciprocating movement that can be imparted by a motor, for example an electric motor, a hydraulic motor, a pneumatic motor, or any other type of actuator, for example also a piston-cylinder actuator. In the embodiment shown the movement according to the double arrow fA is imparted by an electric motor 19 (see in particular FIGS. 2 and 3).

Figure 3:
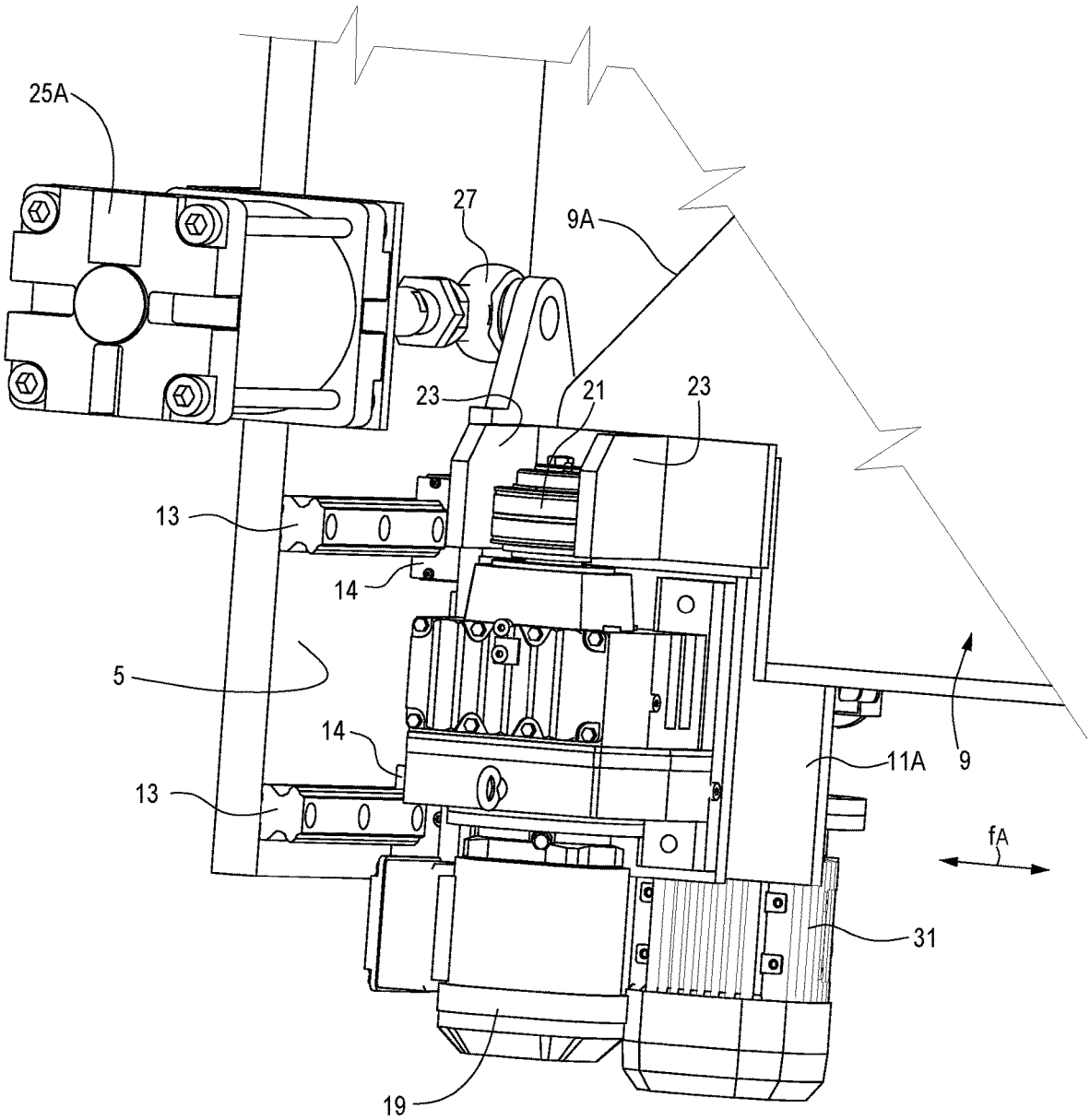
FIGS. 3, 4 and 5 show enlargements of the details indicated with III, IV and V of FIG. 2.
Figure 4:
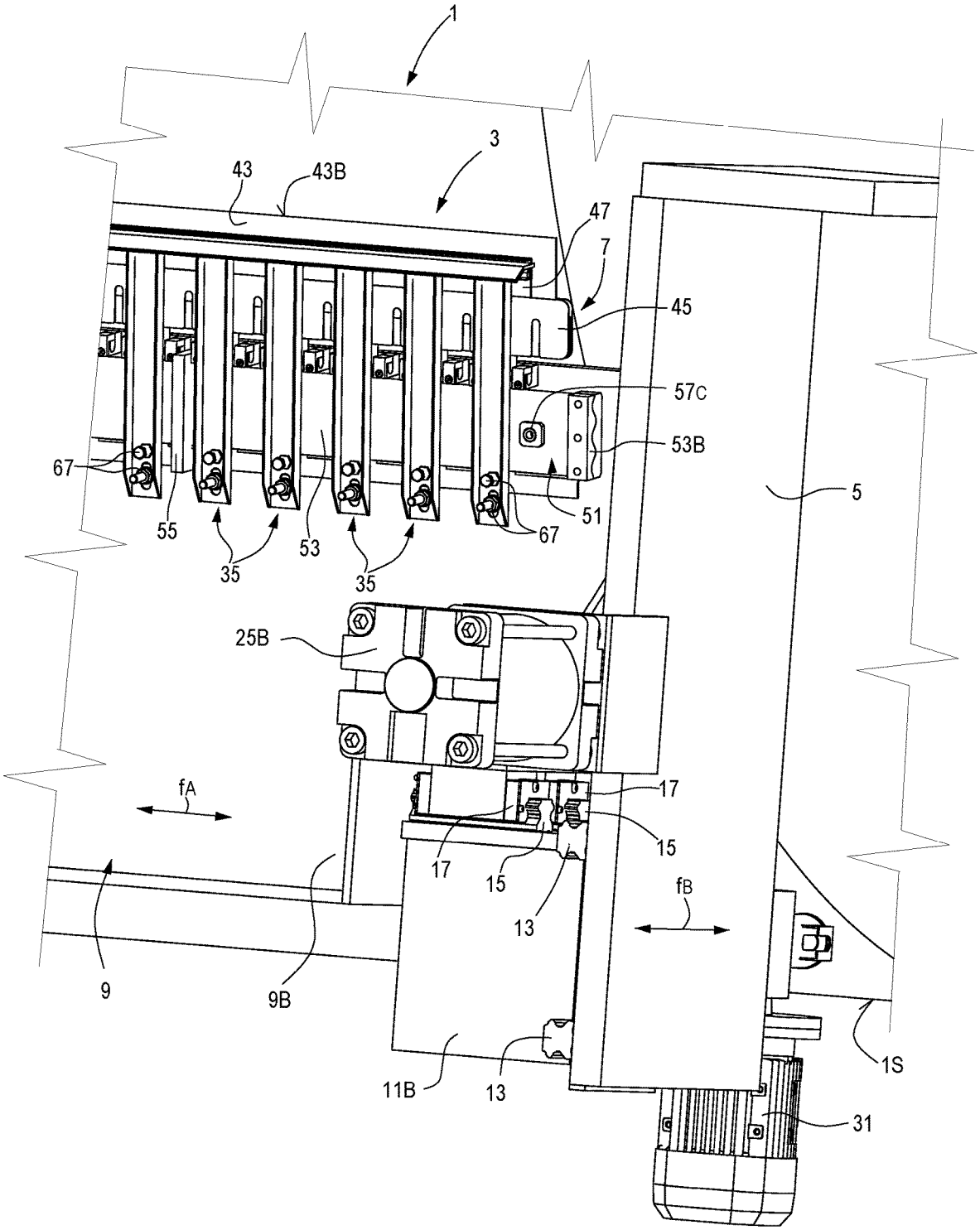

With particular reference to the enlargement of FIG. 3, in some embodiments the motor 19 can rotate a cam or an eccentric 21 that co-acts with two profiles 23 integral with the beam 9, so that rotation of the cam or eccentric 21 causes, through a thrust on the profiles 23, the reciprocating translation movement according to the double arrow fA of the beam 9.

At each end 9A, 9B of the beam 9 there can be associated a respective actuator 25A, 25B, the purpose of which is to urge the beam 9 toward stops that define a working position, in which the creping doctor blade (described below), carried by the doctor blade holder 7, co-acts with the cylindrical surface 1S of the Yankee cylinder 1 and is pressed with its edge against said cylindrical surface. The actuators 25A, 25B can be linear actuators, for example hydraulic or pneumatic piston-cylinder actuators, mechanical jacks, linear electric motors or the like. In the embodiment illustrated, the actuators 25A, 25B are piston-cylinder actuators.

The piston-cylinder actuators 25A, 25B can be coupled on one side to the stationary support structure 5 and on the other, to the ends 9A, 9B of the beam 9 (see in particular the enlargement of FIG. 3). In the example illustrated, the cylinder of each piston-cylinder actuator 25A, 25B is coupled to the load-bearing structure 5 while the rod is coupled, for example by means of a respective ball joint 27, to the beam 9. More in particular, the rods of the actuators 25A, 25B are coupled to the slides 11A, 11B, which in turn carry the beam 9, so as to allow the reciprocating movement of the beam 9 according to the double arrow fA.

Figure 6:
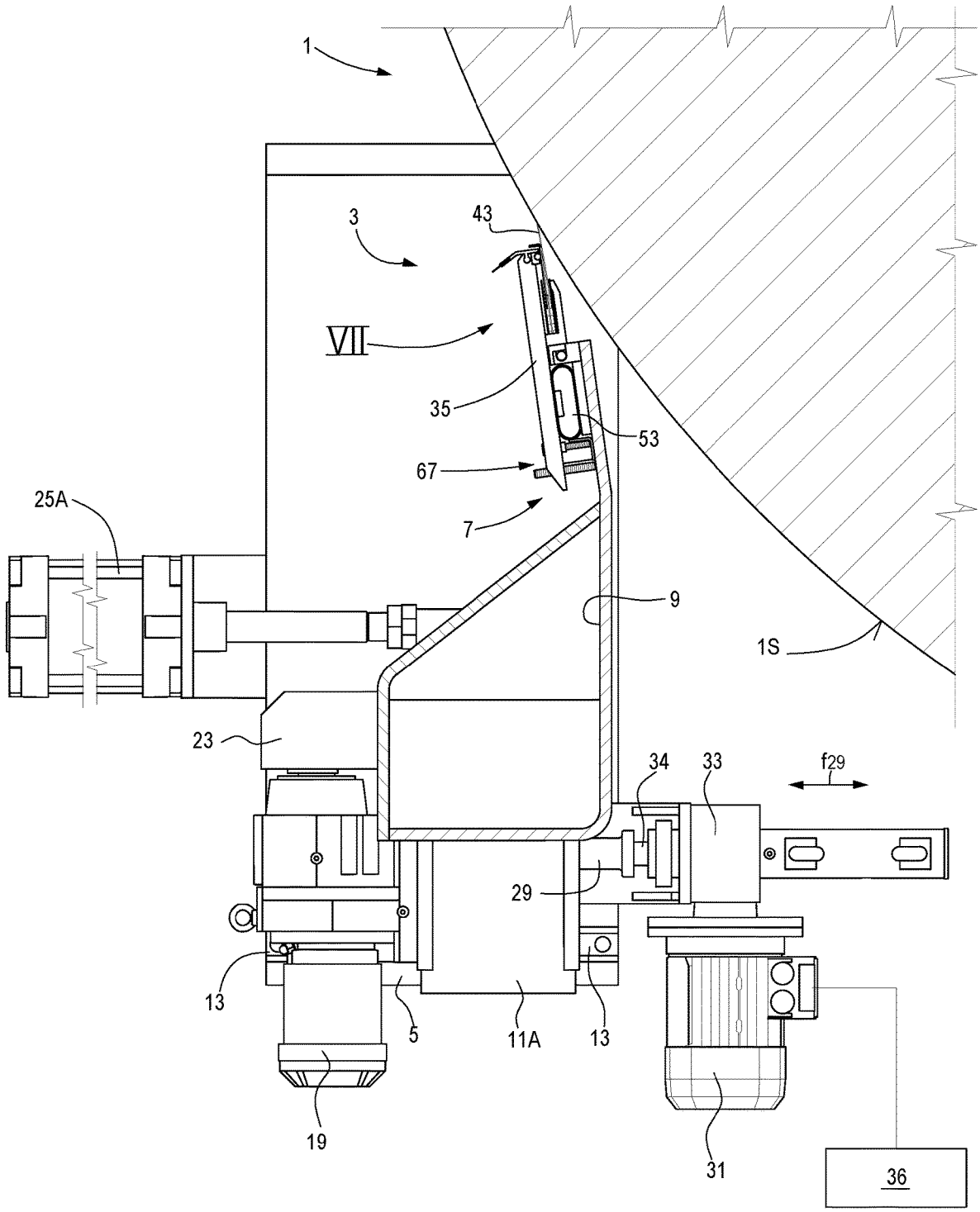
FIG. 6 shows an enlargement of the creping device of FIG. 1.

In some embodiments, the working position of the beam 9 can be defined by adjustable stops. For example, an adjustable stop can be provided for each end 9A, 9B of the beam 9. More in particular, the stops can co-act with the slides 11A, 11B. FIG. 6 illustrates one of said stops, labeled with the number 29, associated with the slide 11A, which is in turn coupled to the end 9A of the beam 9. A similar arrangement can be provided for the end 9B.

The position of the stops 29 can be adjusted in a direction f29 (see FIG. 6) at right angles to the longitudinal extension of the beam 9 and parallel to the direction defined by the linear guides 13. The movement of the stops 29 according to the direction 129 allows the working position of the doctor blade holder 7 with respect to the cylindrical surface 1S of the Yankee cylinder 1 to be modified. In particular, by adjusting the stops 29 it is possible to modify the angle of the creping doctor blade with respect to the cylindrical surface 1S of the Yankee cylinder 1.

In advantageous embodiments, the stops 29 can be motorized. For example, in embodiments described herein, adjustment of the position of each stop 29 according to the direction f29 can be obtained by a servo-motor 31, for example an electronically controlled electric motor, which rotates a threaded bar 34 by means of a suitable reduction gear 33. The respective stop 29 can be coupled to the threaded bar 34 (FIG. 6).

The position of each stop 29 can thus be finely adjusted by operating the respective actuator or servo-motor 31, which can be controlled by a programmable control unit, schematically indicated with 36 (see FIG. 6). Adjustment of the position of the stops 29 allow the position of the two stops at the two ends 9A, 9B of the beam 9 to be finely adjusted.

Figure 5:
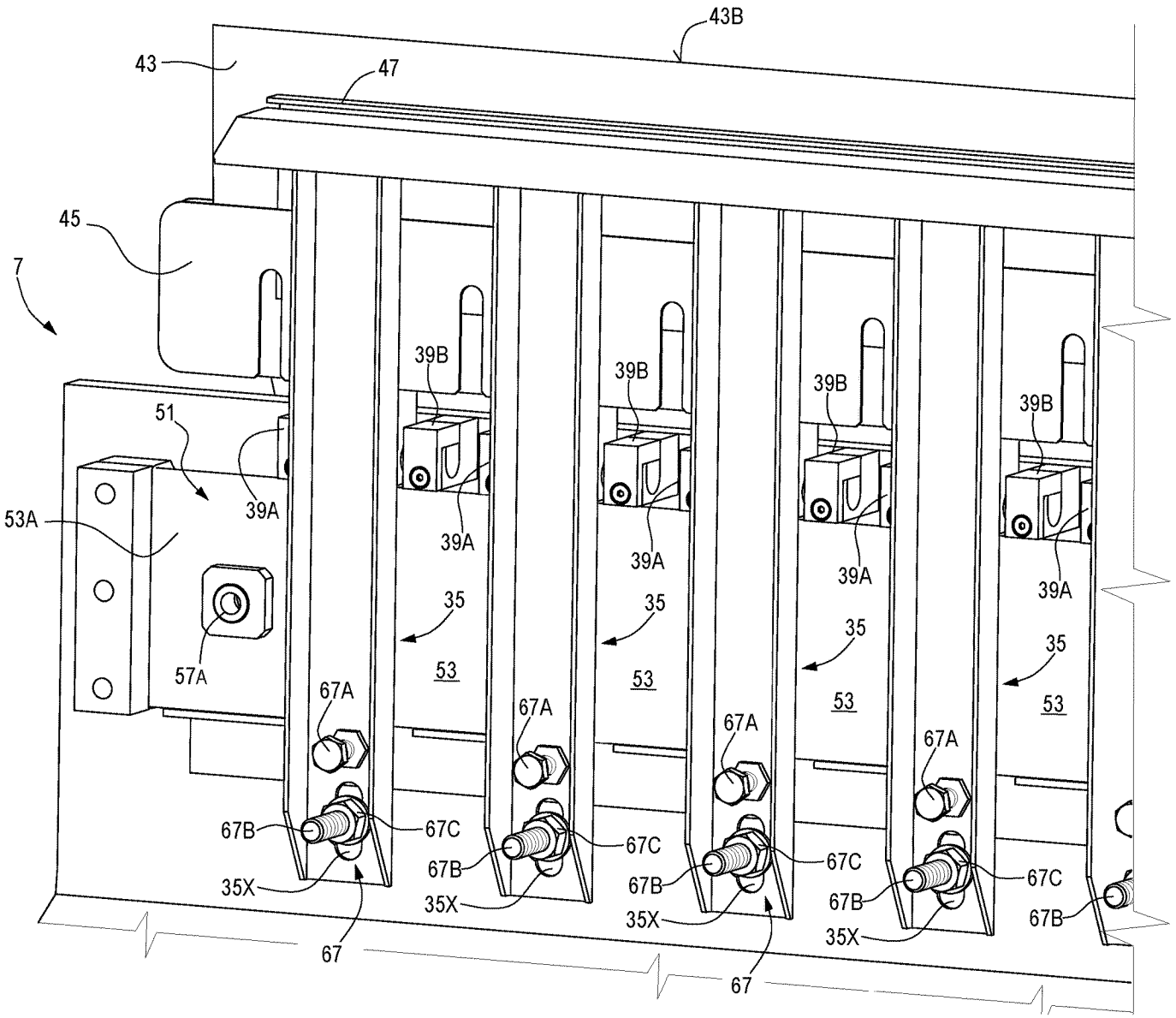
Figure 7:
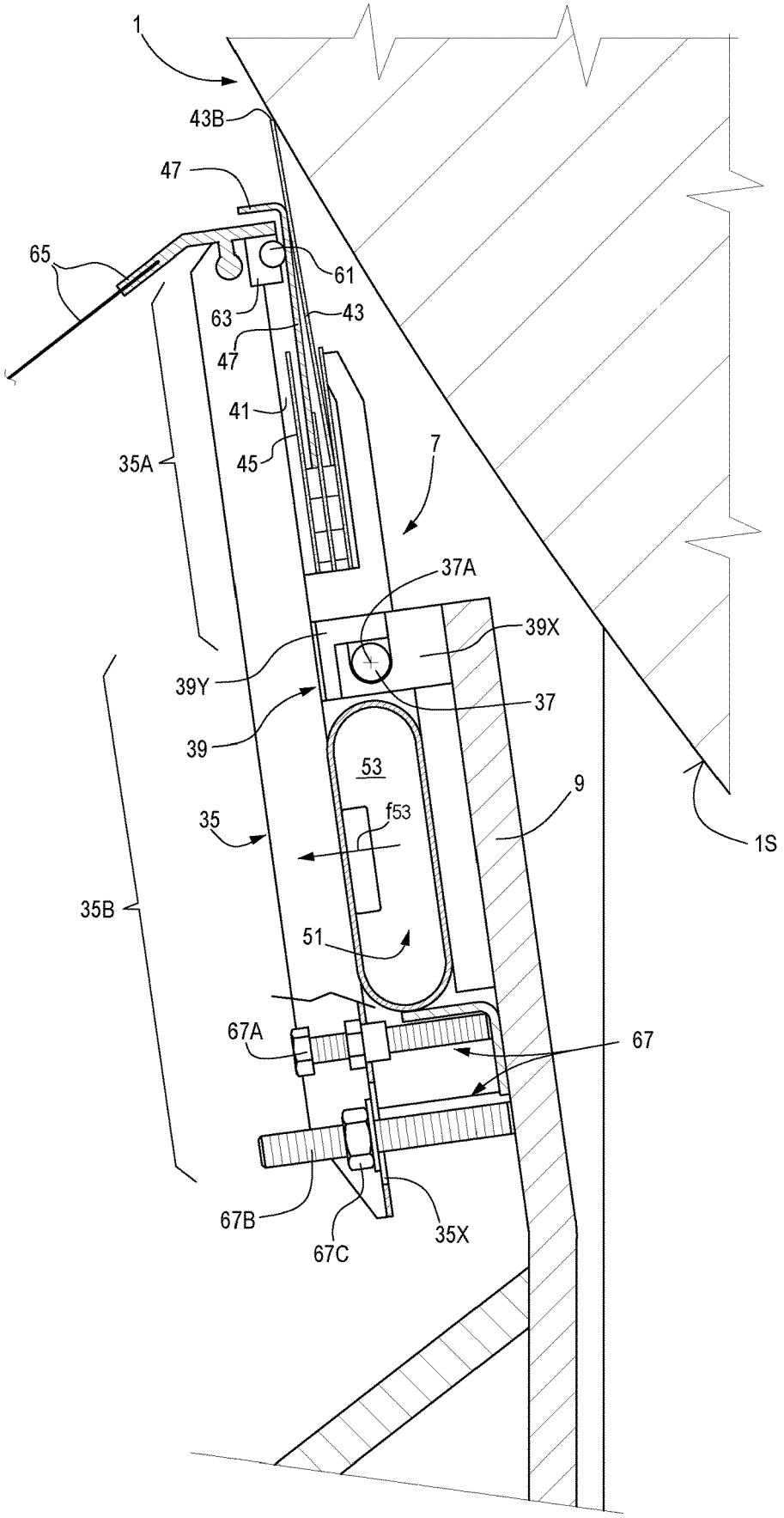
FIG. 7 shows an enlargement of the detail indicated with VII in FIG. 6.

With particular reference to FIGS. 5, 6 and 7, the doctor blade holder 7 can comprise a plurality of fingers 35, each of which can be provided with a hinge pin 37 that defines a rotation axis 37A of the finger 35 with respect to the beam 9. All the hinge axes of the fingers 35 can coincide with one another to define a single rotation axis 37A. The rotation axis 37A is advantageously approximately parallel to the rotation axis A-A of the Yankee cylinder 1.

Each finger 35 can be mounted independently from the other fingers 35 on the doctor blade holder 7. For this purpose, for each finger 35 the doctor blade holder 7 can have a respective hinge support 39 (see in particular detail of FIG. 5). The hinge support 39 is integral with the beam 9.

In some embodiments the support 39 is double for each finger 35, in the sense that the hinge pin 37 of the finger 35 projects from both sides of the finger 35 and engages in two half supports 39A, 39B on the two sides of the finger, jointly forming the hinge support 39.

The hinge support 39 of each finger 35 can be an openable support. In the embodiment illustrated, each half support 39A, 39B is formed by two portions, the one fixed to the beam 9 and the other removable. The configuration is illustrated in detail in FIG. 7, where 39X indicates the fixed portion and 39Y indicates the removable portion of the support 39. By removing the portions 39Y of each half support 39A, 39B it is possible to remove the respective finger 35 and replace it, for example in the case of breakage or damage.

In advantageous embodiments, each finger 35 can be considered as consisting of two portions 35A and 35B that, in the embodiment of FIGS. 1 to 7, are arranged aligned with one another along a straight direction, i.e. form an angle of 180° between them. The two portions 35A, 35B are ideally separated by the hinge pin 37.

Each finger 35 defines in the first portion 35A a compartment 41 in which a doctor blade can be inserted, in particular a creping doctor blade, co-acting with the cylindrical surface 1S of the Yankee cylinder 1. Reference 43B indicates the edge of the creping doctor blade 43, which is pressed against the cylindrical surface 1S of the Yankee cylinder 1 by means of the thrust generated by the piston-cylinder actuators 25A, 25B previously described or, depending on the case, by the action of an inflatable chamber, described below.

In the embodiment illustrated, the doctor blade 43 is mounted in a cartridge 45, which is extracted from the doctor blade holder 7 or inserted in the doctor blade holder 7 together with the doctor blade 43.

The compartments 41 defined by the fingers 35, aligned with one another in the direction parallel to the rotation axis A-A of the Yankee cylinder 1, cumulatively form the housing seat for the doctor blade 43.

In some embodiments, a counter-blade 47 is associated with the doctor blade 43. In the embodiment illustrated the counter-blade 47 can be housed, together with the cartridge 45, in the housing seat formed by the compartments 41 aligned with one another of the fingers 35. The counter-blade 47 can be arranged between the fingers 35 and the doctor blade 43. In this way, the action of the fingers 35 on the doctor blade 43 will be mediated by the interposed counter-blade 47.

The fingers 35 can be urged to pivot around the axis 37A of the respective hinge pins 37 by an actuator indicated as a whole with 51. The actuator 51 can comprise an inflatable chamber 53. A compressible fluid, such as air, can be used to inflate the inflatable chamber 53. However, it would also be possible to use another fluid to pressurize the inflatable chamber 53.

Figure 2:
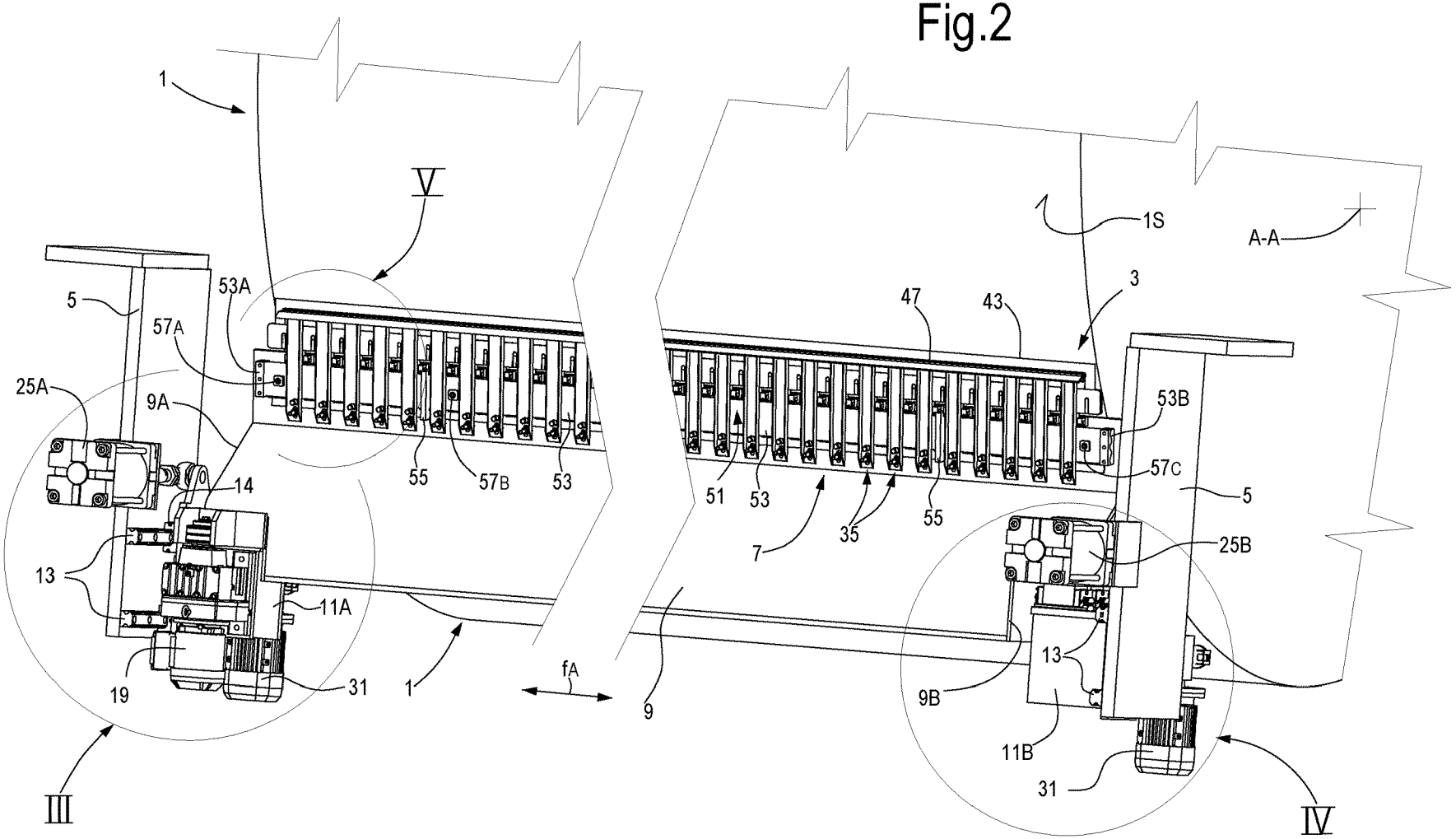
FIG. 2 shows an axonometric view of the creping device of FIG. 1.

As can be seen in particular in FIGS. 2 and 5, the inflatable chamber 53 substantially consists of a tubular element that extends along the doctor blade holder 7, parallel to the longitudinal extension of this latter, and therefore parallel to the edge 43B of the doctor blade 43 and parallel to the rotation axis A-A of the Yankee cylinder 1.

The inflatable chamber 53 can be one, along the whole of the longitudinal extension of the doctor blade holder 7. In this case, a single input point of the pressurized fluid for pressurizing of the inflatable chamber 53 can be provided. In other embodiments, the inflatable chamber 53 can be divided into several sections, for example three sections. Division can be obtained by producing a single tubular shaped inflatable chamber, along the longitudinal extension of which there are provided clamping elements, indicated schematically with 55 (FIGS. 2 and 4), with which the single tubular element is squeezed in predetermined points thus dividing the inner volume of the inflatable chamber 53 into several fluidly separated sections. It is thus possible to inflate the various sections of the inflatable chamber 53 with pressures that are different from section to section. In the embodiment illustrated, the inflatable chamber 53 is divided by the clamping elements 55 into three areas, and more precisely: an intermediate area between the two clamping elements 55 and two outer areas, between each clamping element 55 and the respective end of the tubular element forming the inflatable chamber 53. The ends of the inflatable chamber 53 are indicated with 53A and 53B in FIGS. 2, 4 and 5.

It would also be possible to design the actuator 51 with several inflatable chambers 53 aligned with one another, associated with distinct and separate feed lines for the pressurized fluid, instead of dividing a single tubular element forming a single inflatable chamber 53 into several areas by means of clamping elements 55, as illustrated by way of example in the embodiment shown in the accompanying drawing.

The inflatable chamber 53 can advantageously be provided with a plurality of pressurized fluid input points corresponding to the number of sections into which the inflatable chamber 53 is divided. If several aligned inflatable chambers 53 are provided instead of a single inflatable chamber 53, each of these will be equipped with a pressurized fluid input point to inflate it.

In the example illustrated three pressurized fluid input points are provided, indicated with 57A, 57B and 57C.

It is thus possible to feed fluid at different pressures into the various sections into which the inflatable chamber 53 is divided, or into the single aligned inflatable chambers 53. For example, it is possible to inflate the end sections through the inflation points 57A, 57C to a higher pressure than the inflation pressure of the intermediate area.

When it is inflated by the pressurized fluid, the inflatable chamber 53 of the actuator 51 generates a thrust according to the arrow f53 (FIG. 7) on each finger 35. This thrust generates a torque that urges the respective finger 35 to rotate around the rotation axis 37A and therefore to press against the doctor blade 43 through the counter-blade 47 interposed between the fingers 35 and the doctor blade 43. The thrust generated by the inflatable chamber 53 presses the edge 43B of the doctor blade 43 against the cylindrical surface 1S of the Yankee cylinder 1.

In some embodiments, each finger 35 can be provided with a support element 61. In the embodiment illustrated in the drawing, the support element 61 is formed by a small cylinder housed in a corresponding seat 63 provided near the distal end of the portion 35A of each finger 35.

The reference numeral 65 (FIG. 7) indicates an element to protect and cover the doctor blade holder 7 (only part of which is shown).

The components described above define a doctor blade holder 7 of flexible type, in which the doctor blade 43 is urged against the cylindrical surface 1S of the Yankee cylinder 1 in a flexible manner by the inflatable chamber 53. The pressure inside the inflatable chamber 53 causes a substantially uniform thrust to be exerted on each portion of the doctor blade 43 by each of the fingers 35, with the exception of the difference in pressure that can occur in the three sections into which the inflatable chamber 53 can be divided by the clamping elements 55.

Operation of the doctor blade holder 7 of the creping device 3 described above is as follows. By means of the actuators 31 the positions of the stops 29, if present, are adjusted. The beam 9 of the doctor blade holder 7 is pushed into the working position by the piston-cylinder actuators 25A, 25B. This movement is obtained by sliding the slides 11A, 11B along the preferably straight linear guides 13. The contact pressure of the doctor blade 43 against the cylindrical surface 1S of the Yankee cylinder 1 is generated by the inflatable chamber 53. When the doctor blade holder 7 must be moved away from the cylindrical surface 1S of the Yankee cylinder 1, the piston-cylinder actuators 25A, 25B can be moved back and/or the inflatable chamber 53 can be deflated.

In some embodiments, the beam 9 can be fixed and the movement of the Yankee cylinder 1 toward and away from the cylindrical surface 1S can be obtained by acting exclusively on the inflatable chamber 53. However, this solution has some drawbacks. In particular, the doctor blade 43 can be spaced only at a slight distance from the cylindrical surface 1S of the Yankee cylinder 1.

Vice versa, the embodiment illustrated, in which the beam 9 is movable with respect to the stationary support structure 5 and therefore can be moved further away from the Yankee cylinder 1, ensures better operation of the doctor blade holder 7.

The coupling of the beam 9 to the stationary support structure 5 by means of the preferably straight linear guides 13 makes the beam 9 less flexible and therefore less subject to deformation under the thrust exerted by the cylindrical surface 1S of the Yankee cylinder 1 on the doctor blade 43.

Although in the embodiment illustrated the beam 9 is taken to the working position as a result of the piston-cylinder actuators 25A, 25B co-acting with the adjustable stops 29, in other embodiments there can be provided only a system to push the beam 9 toward the Yankee cylinder 1 for example with electronically controlled electric motors in place of the piston-cylinder actuators 25A, 25B, by means of which a controlled movement is carried out. Alternatively, the movement can be carried out using the intrinsic stops of the piston-cylinder actuators. In yet other embodiments, the working position of the beam 9 and therefore of the doctor blade holder 7 as a whole can be fixed and not adjustable. In this case fixed stops can be provided, for example, instead of the adjustable stops 29 and actuators, for example simple piston-cylinder actuators that push the beam 9 against the fixed stops.

When the doctor blade holder 7 is required to work as a doctor blade holder of rigid rather than flexible type, a locking element, selectively activatable according to operating needs, can be associated with each finger 35.

In some embodiments the locking element can be servo-assisted. For example, clamping jaws can be provided that act on each finger 35, for example on each portion 35B of each finger 35. However, this requires the actuators to be supplied, for example, through a pressurized fluid line or through with an electric line. This might not always be easy, in view of the high longitudinal extension of the doctor blade holder 7, extension that corresponds to the axial length of the Yankee cylinder 1.

In advantageous embodiments, the locking elements can be of manual type. In the embodiment illustrated, each finger 35 is provided with a locking element 67 that is manually operated. The locking elements 67 of each finger 35 are arranged to co-act with the portion 35B of the respective finger 35.

In the embodiment illustrated, each locking element 67 comprises a pair of screws 67A and 67B. The screw 67A can be a screw that thrusts against the beam 9 to generate on the respective finger 35 a force that tends to move the portion 35B of the finger 35 away from the beam 9. Vice versa, the screw 67B can for example be a stud, with which a nut 67C co-acts, and which passes through a slot 35X formed in the respective finger 35. By tightening the nut 67C a force is exerted on the finger 35, which tends to pivot the finger around the rotation axis 37A, to move the portion 35B of the finger 35 toward the beam 9. Acting on the two screw elements 67A, 67B the respective finger 35 is rigidly locked to the beam 9. In this way the doctor blade holder 7 can be converted from a flexible doctor blade holder to a rigid doctor blade holder.

With this particular arrangement it is possible to adapt the doctor blade 43 to the profile of the Yankee cylinder 1, which may not be perfectly cylindrical, applying a substantially uniform thrust on each finger 35 by means of the inflatable chamber 53 when the doctor blade holder is in the flexible arrangement. This thrust causes a flexural deformation of the doctor blade 43 which rests with its edge 43B on the cylindrical surface 1S of the Yankee cylinder 1, adapting to any camber of said cylindrical surface 1S.

Once the doctor blade has been pressed uniformly against the cylindrical surface 1S of the Yankee cylinder 1 under the thrust of the inflatable chamber 53 and of the fingers 35 (operation known as profiling), it is possible to lock the fingers 35 making them rigidly integral with the beam 9 and making the doctor blade holder 7 operate as a rigid doctor blade holder. The profiling operation can take place while the Yankee cylinder 1 is operating, for a given operating time, during which the cylinder can, for example, reach a uniform working temperature and therefore a thermal deformation of the Yankee cylinder 1.

Figure 8:
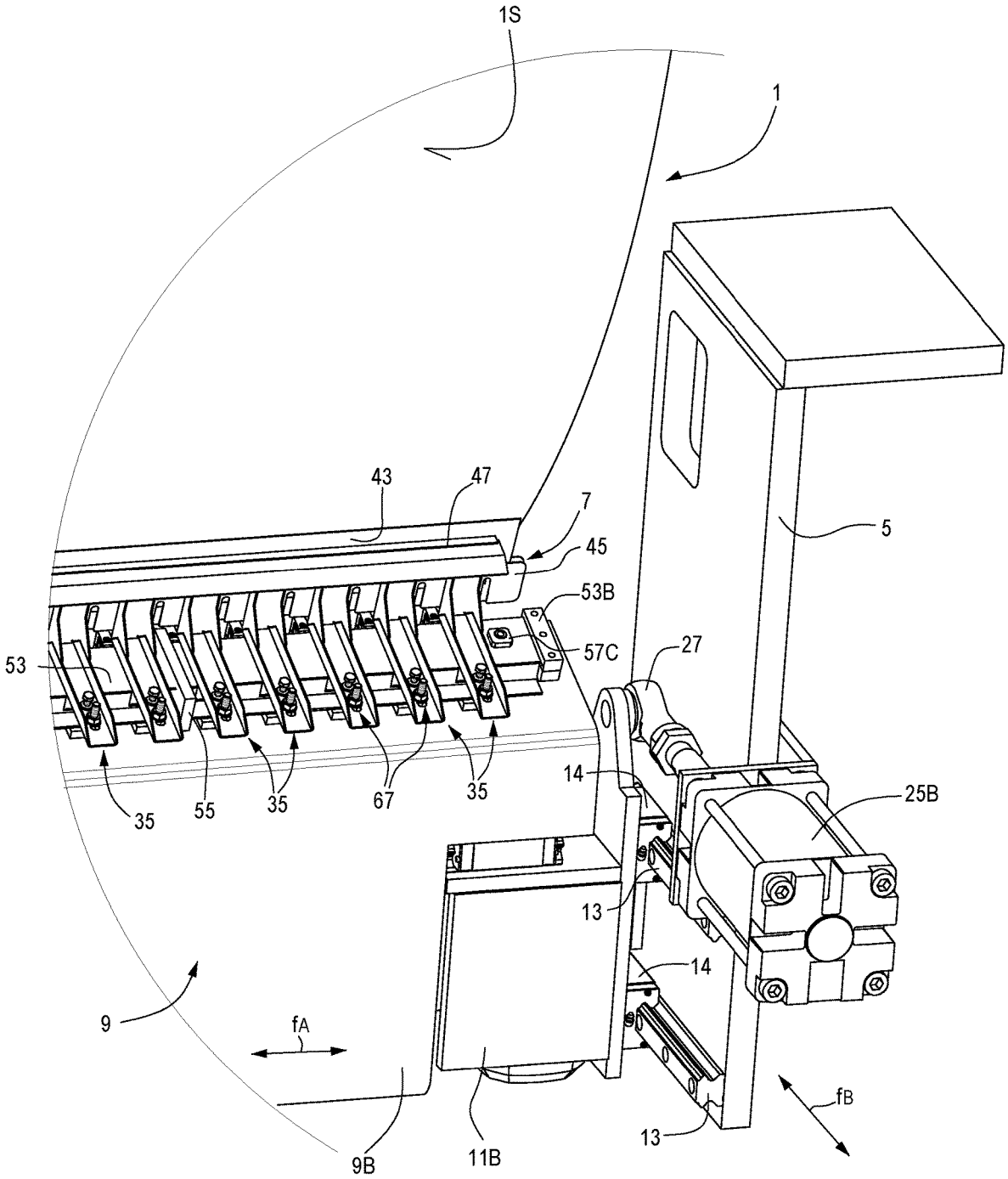
FIG. 8 shows a partial axonometric view of a creping device in a second embodiment.
Figure 9:
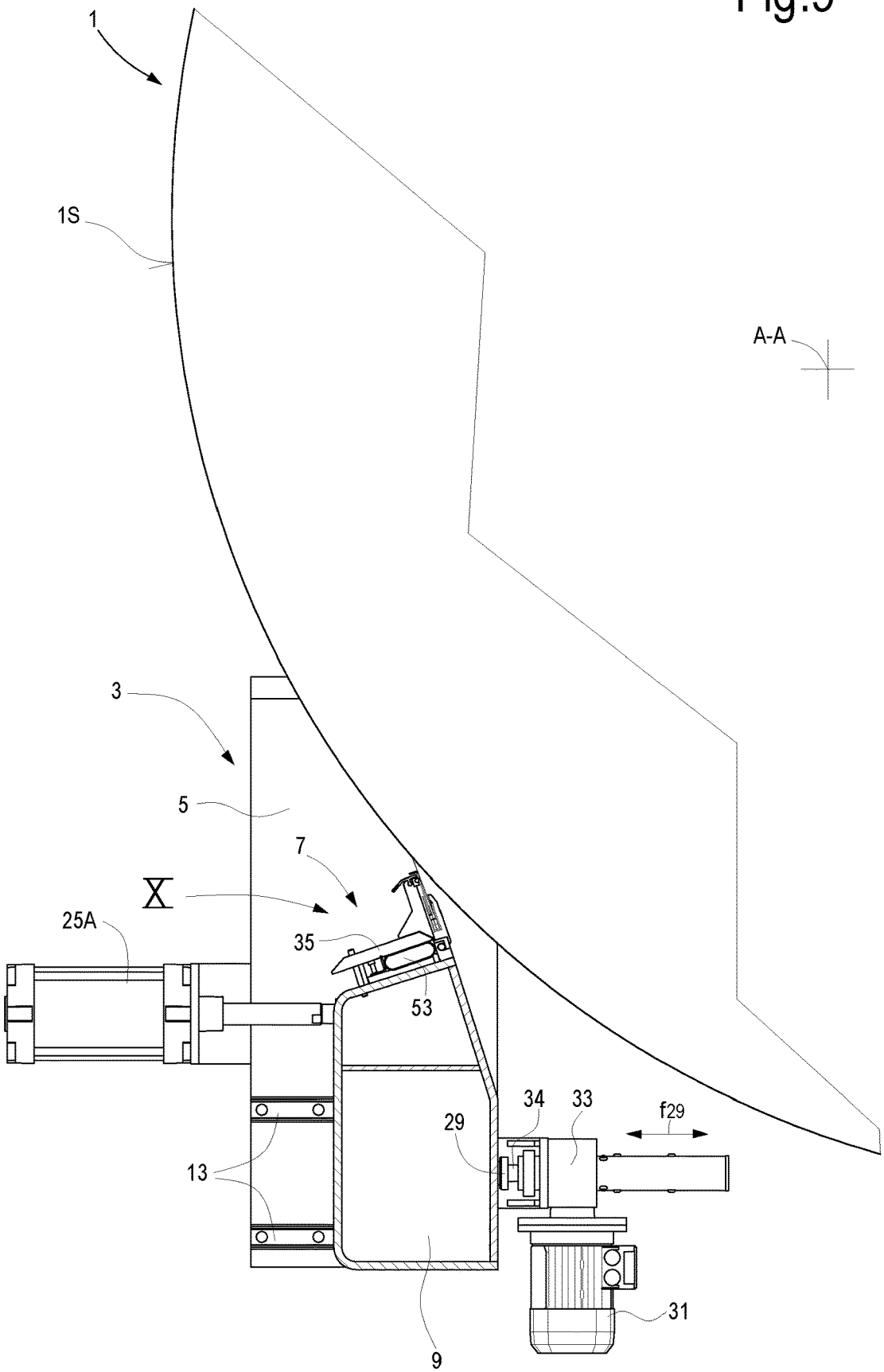
FIG. 9 shows a section of the creping device and of the Yankee cylinder of FIG. 8 according to a plane orthogonal to the rotation axis of the Yankee cylinder.
Figure 10:
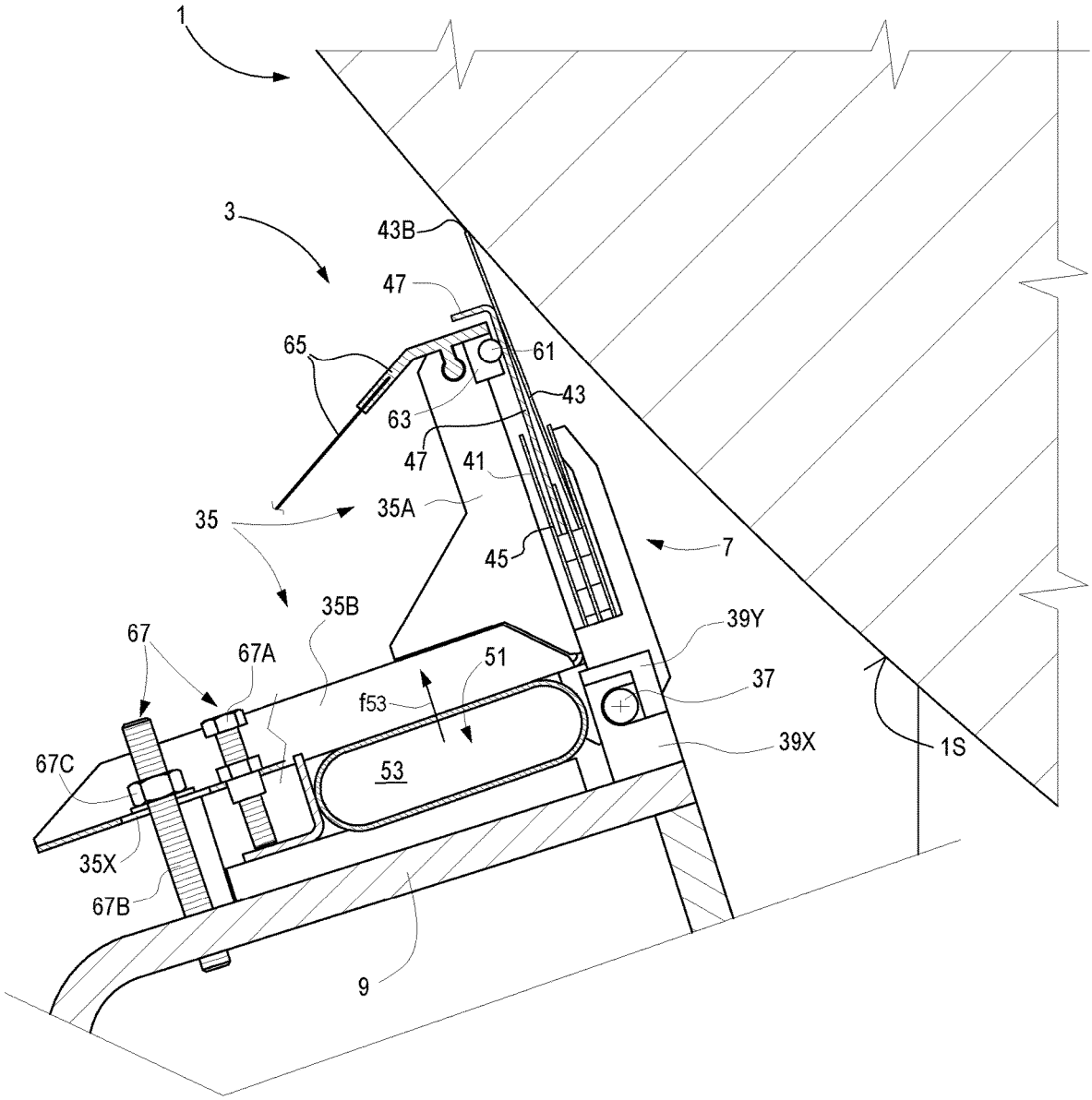
FIG. 10 shows an enlarged view of FIG. 9.

FIGS. 8, 9 and 10 illustrate a further embodiment of the doctor blade holder according to the present disclosure. The same numbers indicate the same or equivalent parts as those already described with reference to FIGS. 1 and 7, which will not be described again. With respect to what has already been illustrated with reference to FIGS. 1 to 7, only the differences will be described in detail below.

In the embodiment illustrated in FIGS. 8 to 10 the fingers 35 are not straight, but are L-shaped. Each finger 35 has a first portion 35A and a second portion 35B, at angle to one another, for example forming an angle of 90°. The hinge pin 37 (see in particular FIG. 10) can be positioned in the area joining the two portions 35A, 35B of the respective finger 35.

The inflatable chamber 53 of the actuator 51 is preferably under the portion 35B of the fingers 35, between the portions 35B and the beam 9. The locking elements 67, also in this case formed by way of example of two screws 67A, 67B, can co-act with the distal portion (i.e. with end farthest from the hinge pin 37) of the respective portions 35B of each finger 35.

The embodiment of FIGS. 8 to 10 allows better access both to the inflatable chamber 53, and to the locking elements 67.

Figure 11:
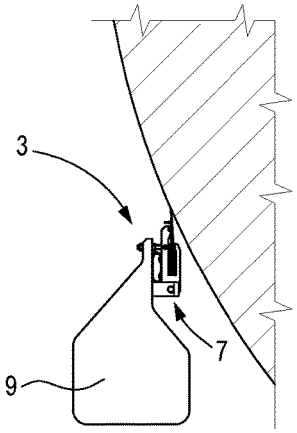
FIG. 11 shows a section according to a plane orthogonal to the rotation axis of the Yankee cylinder of a further embodiment.
Figure 12:
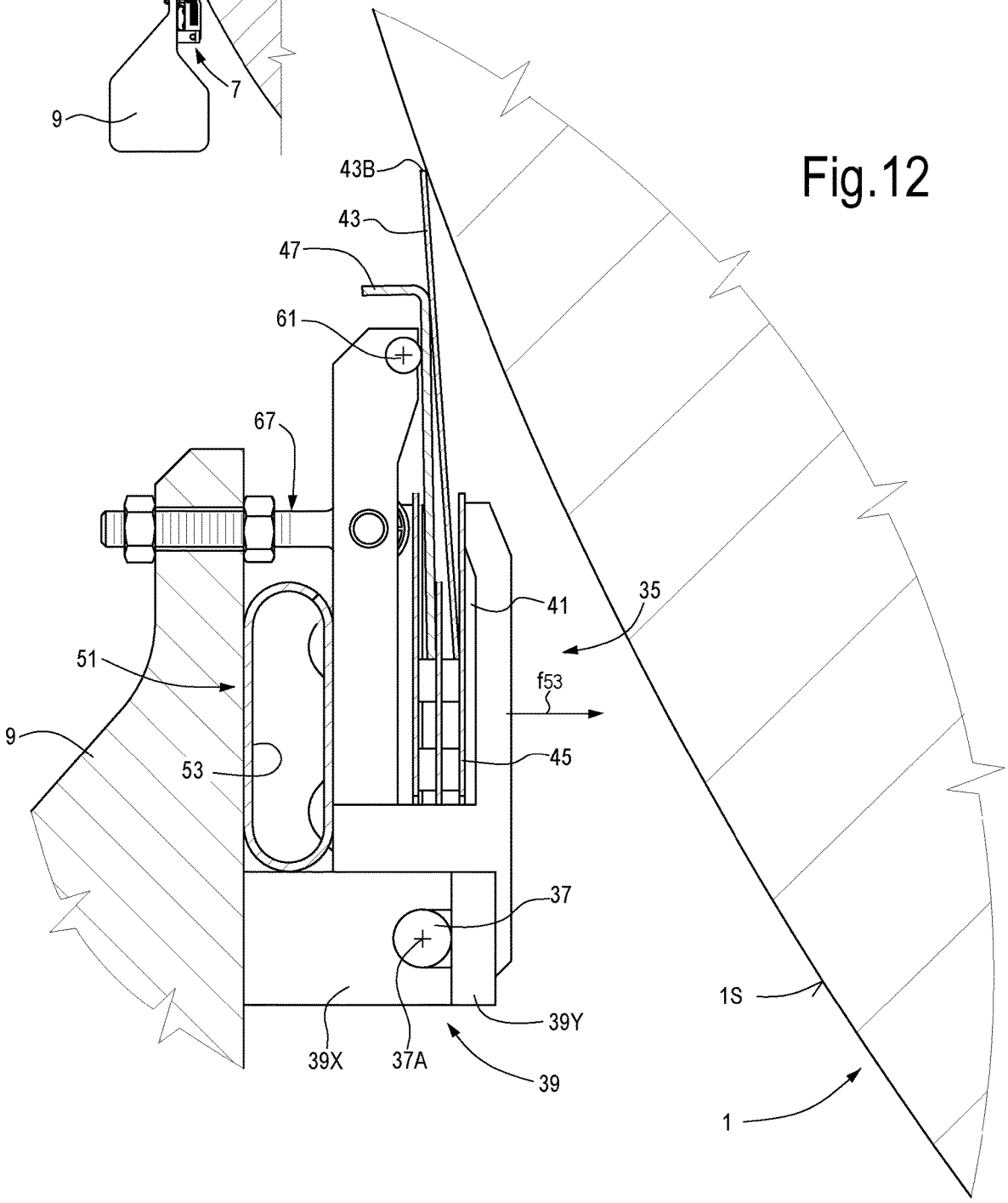
FIG. 12 shows an enlargement of the blade holder of FIG. 11.

FIGS. 11 and 12 illustrate a further embodiment of a doctor blade holder 7 of a creping device 3. The same numbers indicate the same or equivalent parts to those already described with reference to the embodiments illustrated previously. In the embodiment of FIGS. 11 and 12 the fingers 35 are hinged at a first proximal end, opposite with respect to the edge 43B of the creping doctor blade 43, around a rotation axis 37A by means of a hinge pin 37. To obtain the necessary thrust (arrow f53) of the doctor blade 43 against the surface 1S of the Yankee cylinder 1, the fingers 35 are positioned between the Yankee cylinder 1 and the beam 9, while the actuator 51 with the respective inflatable chamber 53 is positioned between the fulcrum represented by the rotation axis 37A and the distal ends (opposite the rotation axis) of the fingers 35. The remaining components of the creping device 3 can be substantially the same as those already described. In particular, the beam 9 can be supported movably to move toward and away from the surface 1S of the Yankee cylinder, optionally with the presence of adjustable stops, and can be provided with a reciprocating translation movement parallel to the longitudinal extension of the beam 9. Moreover, each finger 35 can be provided with respective locking elements 67, which also in this case can have push and pull screw means. The locking elements 67 are in this case arranged between the rotation axis 37A and the distal end of the fingers 35, i.e., the end opposite the one hinged to the rotation axis 37A. The inflatable chamber 53 is placed between the locking elements 67 and the rotation axis 37A.

Figure 13:
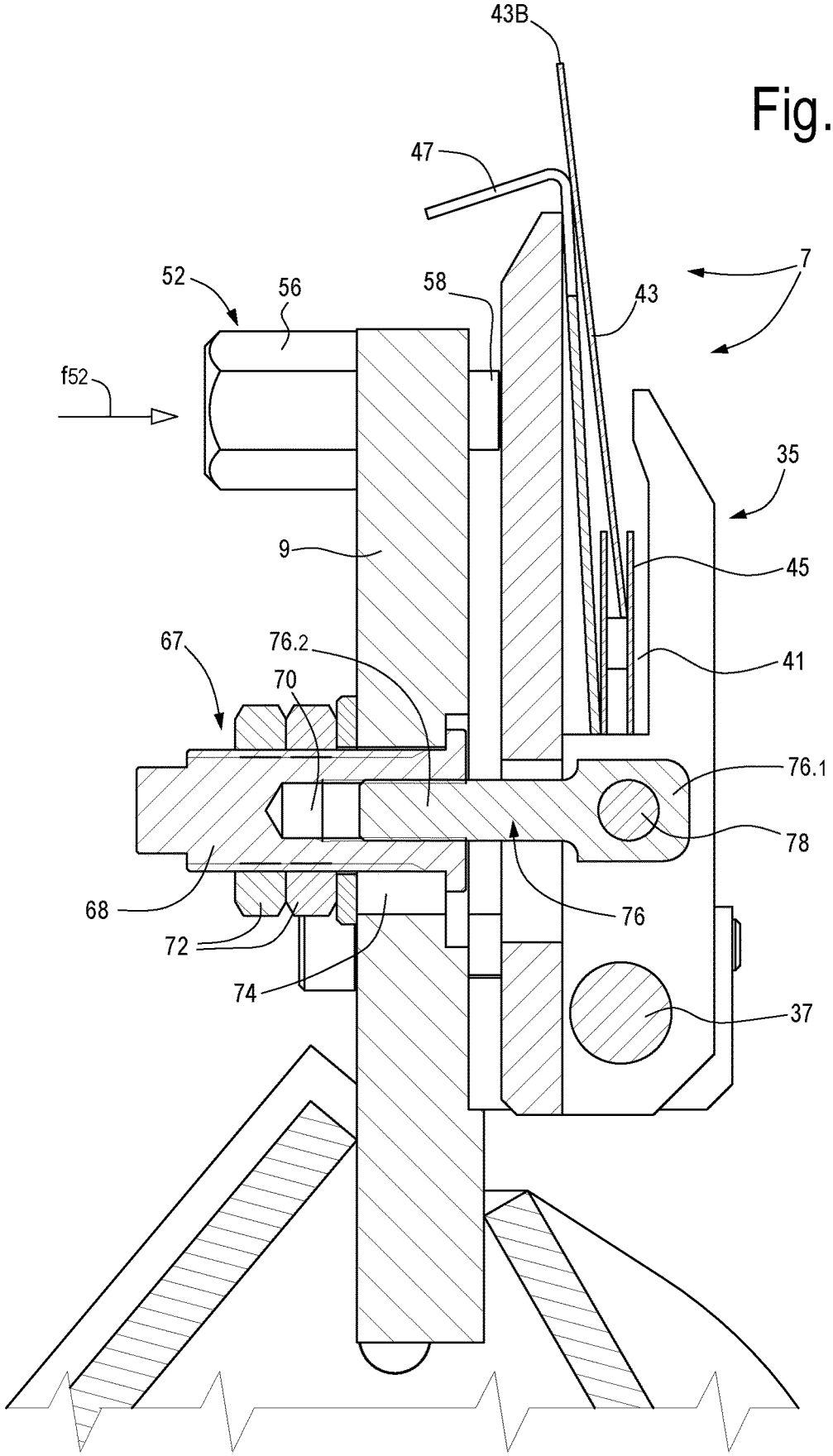
FIGS. 13 and 14 illustrate modified embodiments.
Figure 14:
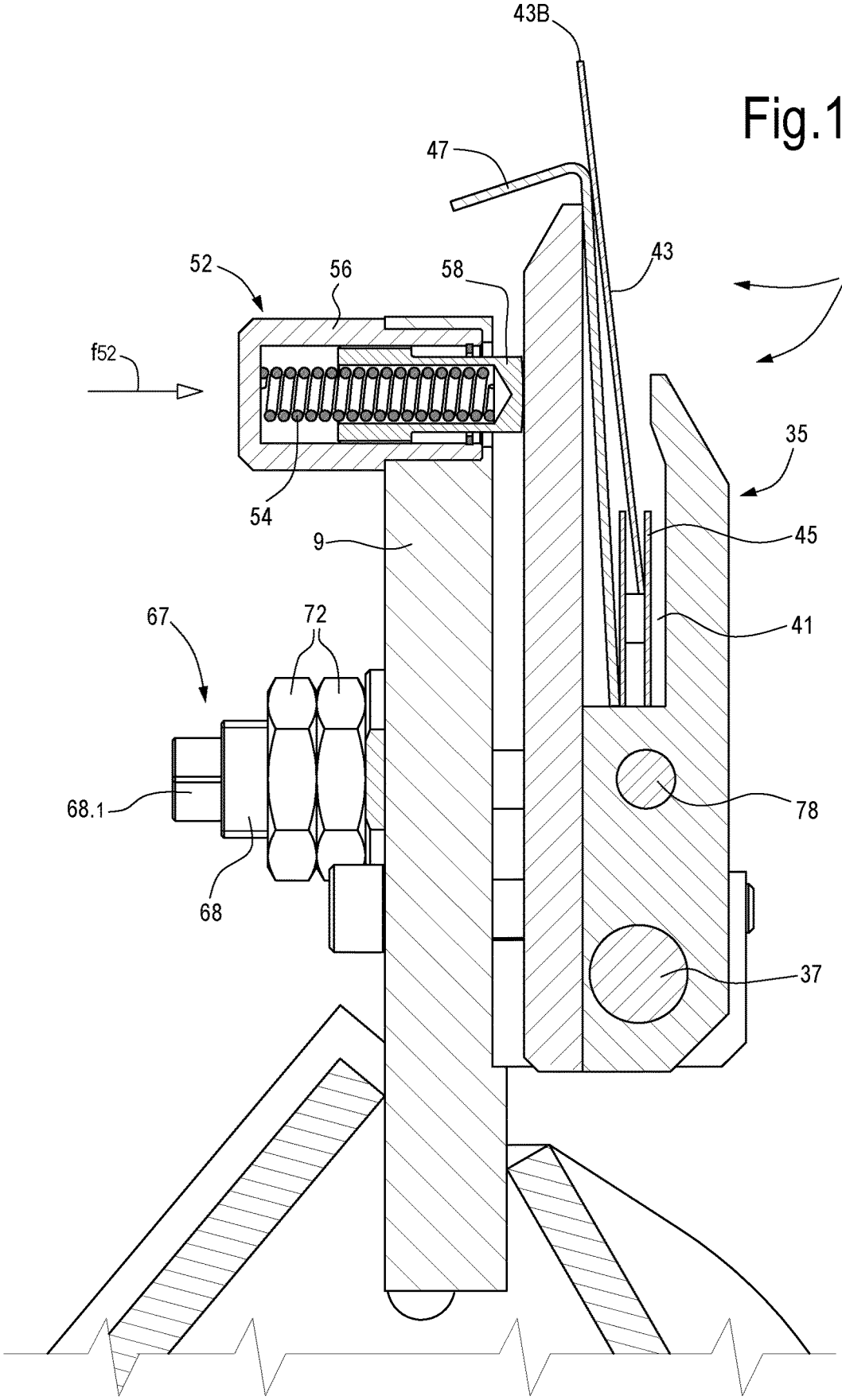

While in the embodiments described above the doctor blade 43 is pushed by a thrust member 51 with an inflatable chamber 53, in other embodiments the creping doctor blade can be elastically thrust by a different thrust member or actuator, for example a system of springs. FIGS. 13 and 14 show sections similar to those of FIG. 7 of a doctor blade holder 7 for a doctor blade or a creping doctor blade 43. The doctor blade holder 7 comprises a plurality of fingers 35 hinged around a pin 37, which can be removable. The same or equivalent parts to those described above are designated with the same reference numbers and will not be described again.

FIGS. 13 and 14 illustrate two sections of the doctor blade holder 7 according to two planes parallel to each other and at right angles to the edge 43B of the doctor blade 43.

In the embodiment of FIGS. 13 and 14 the thrust member or actuator 51 with inflatable chamber 53 is replaced by a thrust member 52, comprising an arrangement of elastic elements, for example one or more springs 54. The thrust generated by the thrust member 52 on the creping doctor blade 43 is indicated with f52. In practice, the thrust member 52 comprises a plurality of springs 54 aligned with one another parallel to the edge 43B of the creping doctor blade 43. One of the springs 54 is shown in section in FIG. 14. Each spring 54 can be housed in a cylindrical chamber 56 screwed into a respective hole of the beam 9. Each spring 54 can be provided with a cap 58 that is retained in the seat formed by the cylindrical chamber 56 and that projects axially therefrom pressing against a respective finger 35, under the elastic thrust of the spring 54.

With this arrangement each finger 35 can be associated with a respective elastic element, such as the spring 54, to be pushed toward the Yankee cylinder 1 (not shown in FIGS. 13 and 14). The doctor blade holder 7 can therefore behave as an elastic doctor blade holder.

While FIG. 14 shows an elastic element in the form of a single compression coil spring 54 for each finger 35, it would also be possible to provide more complex arrangements, for example with several springs in series and/or in parallel, of coil or other type, for example Belleville springs, also combined with one another, to obtain suitable elastic characteristics.

The doctor blade holder 7 of FIGS. 13 and 14 is provided, similarly to what is described with reference to FIG. 7, with a locking system or element to rigidly lock each finger 35 with respect to the beam 9.

The locking element of each finger 35 can be mounted staggered with respect to the corresponding elastic actuator, i.e. to the spring 54 and related housing. For this reason, the locking element is represented in the section of FIG. 13 and is not visible in the section of FIG. 14, while the spring 54 is shown in the section of FIG. 14 but is not visible in the section of FIG. 13.

In the embodiment of FIGS. 13 and 14 each locking element, again indicated as a whole with 67, comprises a bushing 68 with an outer thread and an inner thread, provided in a hole 70. The bushing is inserted into a hole 74 of the beam 9 and can be rigidly locked with respect to the beam 9 by means of a pair of nuts 72. A tie rod 76 can be screwed with its threaded stem 72.2 into the threaded hole 70 of the bushing 68. The tie rod 76 also has a head 76.1 secured to the respective finger 35.

The rigid locking element 67 functions in the following way, to lock the respective finger 35. The tie rod 76 is secured to the finger 35 and screwed into the threaded hole 70 of the bushing 68. For this purpose the bushing, once housed in the hole 74, can be rotated by means of a tool that acts on a square head 68.1 of the bushing (see FIG. 14). In this way the tie rod 76 pushes the finger 35 to rest rigidly against the cap 58, completely compressing the spring 54 in the cylindrical chamber. After reaching complete compression of the spring 54, the bushing 68 can be locked against the beam 9 by tightening the nut and the lock nut 72. After these operations have been carried out for each locking element 67 of each finger 35, the doctor blade holder 7 behaves like a rigid doctor blade holder.

In the present context, the term "spring" can also be understood, for example, as a solid body made of an elastically yielding material, such as rubber, synthetic rubber or natural rubber, or another elastically yielding material, which in substance forms an accumulator of elastic potential energy due to its deformation. Therefore, the term "spring"

also generally comprises a body made with a material that, deforming due to an external force, accumulates elastic potential energy.

The above description provided by way of example relates to advantageous embodiments of the invention, which is defined in the appended claims.

What is claimed is:

1. A doctor blade holder for a doctor blade adapted to co-act with a cylindrical surface of a rotating cylinder, the doctor blade holder comprising:

a beam; and a plurality of fingers mounted on the beam and hinged around a rotation axis and configured to cumulatively form a housing seat for the doctor blade, wherein the fingers are pivotable independently from one another around said rotation axis, wherein each finger is mountable and removable independently from the others on said beam.

2. The doctor blade holder of claim 1, further comprising at least one thrust member adapted to generate a thrust on the fingers to make the fingers pivot around said rotation axis against the cylinder surface.

3. The doctor blade holder of claim 2, wherein the thrust member is an elastic thrust member.

4. The doctor blade holder of claim 2, wherein the thrust member comprises one or more of: an inflatable chamber configured to be inflated with pressurized fluid, an elastic body, a spring and a plurality of springs distributed along the beam.

5. The doctor blade holder of claim 2, wherein each finger comprises a first portion, defining the seat for the doctor blade and a second portion, co-acting with said thrust member, the rotation axis being located between the first portion and the second portion.

6. The doctor blade holder of claim 5, wherein the first portion and the second portion of each finger are placed at an angle to one another, the angle being comprised between 60° and 120°.

7. The doctor blade holder of claim 5, wherein the first portion and the second portion of each finger are aligned with one another.

8. The doctor blade holder of claim 5, wherein each finger comprises a locking element, to rigidly lock the finger in place with respect to the beam, and wherein the locking elements are placed so as to act on the second portion of the respective finger.

9. The doctor blade holder of claim 2, wherein each finger is hinged to the beam at a first proximal end of the finger, wherein the doctor blade seat is positioned between the first proximal end and a second distal end of the fingers, opposite the rotation axis, wherein the thrust member is positioned between the first proximal ends and the second distal ends of the fingers.

10. The doctor blade holder of claim 9, wherein each finger comprises a locking element, to rigidly lock the finger in place with respect to the beam, and wherein the locking elements are placed between the rotation axis and the second portion of the respective fingers, wherein the inflatable chamber is placed between the locking elements and the rotation axis.

11. The doctor blade holder of claim 1, further comprising a counter-blade, on which said fingers act, the counter-blade being arranged between the fingers and the doctor blade, so as to press on to the doctor blade housed in the doctor blade seat.

12. The doctor blade holder of claim 1, wherein each finger comprises a hinge pin and wherein for each finger the beam comprises an openable support, wherein the hinge pin of the respective finger is rotatingly engaged.

13. The doctor blade holder of claim 12, wherein each hinge pin is located between the first portion and the second portion of the respective finger.

14. The doctor blade holder of claim 1, wherein each finger comprises a locking element, to rigidly lock the finger in place with respect to the beam.

15. The doctor blade holder of claim 14, wherein each locking element comprises a pair of screws co-acting with the beam and with the finger, to rigidly lock the finger in place with respect to the beam.

16. The doctor blade holder of claim 1, wherein said beam is movable along a system of linear translation guides, placed at the ends of the beam, said linear guides being placed at right angles to the longitudinal extension of the beam.

17. The doctor blade holder of claim 16, further comprising, at each end of the beam, a respective actuator configured to move the respective end of the beam along said system of straight guides towards a working position, wherein the doctor blade is pressed against the cylinder.

18. The doctor blade holder of claim 17, further comprising, at each end of the beam, an adjustable stop element, which defines the working position.

19. The doctor blade holder of claim 17, wherein each end of the beam is coupled to a respective slide, movable along said system of linear guides.

20. The doctor blade holder of claim 19, wherein the ends of the beam are coupled to the respective slides by sliding guides substantially parallel to the longitudinal extension of the beam, and wherein a drive element is provided, to impart a reciprocating movement of the beam parallel to the longitudinal extension thereof.

21. A system comprising a cylinder rotating around an axis of rotation and a doctor blade holder according to claim 1, the doctor blade holder being configured to hold a doctor blade co-acting with a cylindrical surface of the rotating cylinder.

22. The system of claim 21, wherein the doctor blade is arranged in the seat defined by said fingers, the doctor blade having an edge pressing against the cylindrical surface of the rotating cylinder.

23. The system of claim 21, wherein a cartridge for containing the doctor blade, housed in the seat is provided.

* * * * *